United States Patent [19]

DeVries et al.

[11] Patent Number: 5,067,882

[45] Date of Patent: Nov. 26, 1991

[54] DUAL-ACTING, RECIPROCATING PISTON PUMP

[75] Inventors: James E. DeVries, North Olmsted, Ohio; Samuel R. Rosen, Scottsdale, Ariz.; Robert D. Schneider, Lorain, Ohio

[73] Assignee: Nordson Corporation, Westlake, Ohio

[21] Appl. No.: 540,934

[22] Filed: Jun. 20, 1990

[51] Int. Cl.[5] ..... F04B 7/00

[52] U.S. Cl. ..... 417/511; 417/512; 417/520; 417/900; 137/528

[58] Field of Search ..... 417/512, 514, 900, 511, 417/517, 518, 520; 137/528

[56] References Cited

U.S. PATENT DOCUMENTS

| | | | |
|---|---|---|---|
| 1,688,195 | 10/1928 | MacGregor | 417/512 |
| 2,204,798 | 6/1940 | Ferguson | 417/512 |
| 3,335,673 | 8/1967 | Forrest | 417/511 |
| 3,532,446 | 10/1970 | Herreshoff | 417/511 |
| 3,904,325 | 9/1975 | Olofsson et al. | 417/512 |
| 3,920,356 | 11/1975 | Bruggeman | 417/511 |
| 4,377,180 | 3/1983 | Biljes | 137/528 |

*Primary Examiner*—Richard A. Bertsch
*Assistant Examiner*—Michael I. Kocharov
*Attorney, Agent, or Firm*—Wood, Herron & Evans

[57] ABSTRACT

A dual-acting, reciprocating piston pump is provided which comprises a pump body formed with a passageway having an inlet and a discharge outlet which receives a piston assembly including a plunger rod carrying a valve plate or spider, a shovel rod carrying a shovel disc and a rod connector formed with a valve seat which interconnects the plunger rod and shovel rod. A tubular check valve is carried on the rod connector between the valve seat and the valve plate in sliding contact with the internal wall in the pump body formed by the passageway, which divides the passageway into an upper pumping chamber communicating with the discharge outlet and a lower pumping chamber communicating with the inlet. A second check valve is located at the inlet to the passageway in the pump body and is movable between an open and closed position relative thereto.

5 Claims, 2 Drawing Sheets

DUAL-ACTING, RECIPROCATING PISTON PUMP

FIELD OF THE INVENTION

This invention relates to reciprocating piston pumps, and, more particularly, to a dual-acting reciprocating piston pump for ultra-high viscosity materials in which the flow of material through the pump is relatively clear and unobstructed to avoid excessive shear, pressure losses and packing out.

BACKGROUND OF THE INVENTION

Double-acting, reciprocating piston pumps are characterized by the capability of pumping material in both directions of the piston stroke. Pumps of this type, such as disclosed, for example, in U.S. Pat. Nos. 3,160,105 and 3,995,966, include a pump body formed with a longitudinally extending passageway which is divided into first and second pumping chambers by a check valve. One of the pumping chambers communicates with a discharge outlet formed in the pump body and the other pumping chamber has an inlet which communicates with a source of the material to be pumped. In one direction of piston movement within the passageway, the check valve is moved to a closed position and material is simultaneously forced out of the first pumping chamber through the discharge outlet in the passageway and scooped from the source of material through the inlet into the second pumping chamber. Movement of the piston in the opposite direction opens the check valve to permit the passage of material from the second pumping chamber into the first pumping chamber where it is ejected through the discharge outlet therein.

Dual-acting, reciprocating piston pumps of the type described above are effective in certain applications, but problems can be experienced in pumping materials having a relatively high viscosity. In order to pump highly viscous materials, the flow passageways through the pump, and particularly through the check valve and between the pumping chambers, must be as clear and unobstructed as possible. If such passageways are relatively small and/or elongated, for example, the pumping of high viscosity materials therethrough tends to create problems of excessive shear, pressure loss between the pumping chambers and "packing out" or the build-up of material along the surfaces of the passageways and/or piston which restricts flow therethrough.

For example, U.S. Pat. No. 3,995,966 discloses a double-acting, reciprocating piston pump in which an elongated piston or plunger is formed with a relatively large diameter, compared to the diameter of the passageway in the pump body between the two pumping chambers, such that a relatively small material flow path is formed between the pumping chambers. This elongated, small flow passageway is unacceptable when pumping high viscosity materials because the problems of excessive shear, pressure drop and packing out mentioned above can be created in this area. Additionally, in the pump disclosed in the U.S. Pat. No. 3,995,966 and others of this type, no means is provided to scrape or wipe material from the wall formed by the passageway in the pump body. While some pump designs include a scraper or the like for wiping material from the piston, the wall of the passageway in the pump body is not cleaned and can accumulate material during operation of the pump.

SUMMARY OF THE INVENTION

It is therefore among the objectives of this invention to provide a dual-acting, reciprocating piston-type pump which permits relatively clear and unobstructed flow of high viscosity materials therethrough, which is compact in construction and which is easy to assemble and disassemble for maintenance.

These objectives are accomplished in a dual-acting, reciprocating piston pump which comprises a pump body formed with a passageway having an inlet and a discharge outlet. The passageway receives a piston assembly including a plunger rod carrying a valve plate or spider, a shovel rod carrying a shovel disc and a rod connector formed with a valve seat which interconnects the plunger rod and shovel rod. A tubular check valve is carried on the rod connector between the valve seat and the valve plate which divides the passageway into an upper pumping chamber communicating with the discharge outlet, and a lower pumping chamber communicating with the inlet. A second check valve is located at the inlet to the passageway in the pump body and is movable between an open and closed position relative thereto.

This invention is predicated upon the concept of minimizing restrictions to the flow of material between the upper and lower pumping chambers to reduce problems of excessive shear, pressure drop and packing out. The pump body is compact in construction with a relatively short distance being provided between the upper and lower pumping chambers, and between the inlet and discharge outlet of the passageway, so that pressure losses associated with the flow of material therebetween are minimized. Restrictions in flow through the pump body, particularly in the area between the pumping chambers, are minimized by the construction of the tubular check valve carried by the connector rod. This check valve has a large throughbore to readily permit the passage of material therethrough, and a chamfered end engageable with the valve seat of the rod connector which helps direct the flow of material from the lower chamber into the check valve and to permit a sharp cut-off of material flow upon engagement with the valve seat when the check valve is moved to a closed position. These features of the tubular check valve herein aid in reducing pressure losses between the pumping chambers, and prevent the development of excessive shear and thus overheating of the high viscosity material as it moves between the upper and lower chambers.

Another advantage provided by the tubular check valve of this invention is the reduction of packing out or build-up of material along the wall formed by the passageway in the pump body. In the presently preferred embodiment, the outer surface of the tubular check valve slidably engages the inner wall of the pump body and effectively wipes or scrapes material therefrom to prevent a build-up which could restrict the flow of material through the pump. Because the tubular check valve is carried by the rod connector portion of the piston assembly, it is movable therewith along a substantial length of the wall of the passageway. As a result, a large section of the wall formed by the passageway in the pump body is wiped or scraped of material to maintain it relatively clean during the pump operation.

The shovel rod carried by the rod connector extends from the lower pumping chamber, out through the inlet to the passageway in the pump body, and is adapted to be inserted into the interior of a drum or other container filled with material to be pumped. The lowermost end of the shovel rod carries a shovel disc fixedly mounted thereto, and a washer plate movable with respect to the shovel disc. Preferably, the shovel disc is formed with a number of apertures.

In the course of the downstroke movement of the piston assembly, the shovel rod is thrust downwardly into the material container forcing the washer plate out of engagement with the shovel disc. The apertures in the shovel disc allow material to pass therethrough to facilitate movement of the shovel disc through the high viscosity material in the container. When the movement of the shovel rod is reversed during an upstroke of the piston assembly, the washer plate is moved into engagement with the shovel disc to close the apertures therein so that material within the container can be scooped by the shovel disc and directed through the inlet in the pump body into its lower pumping chamber.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
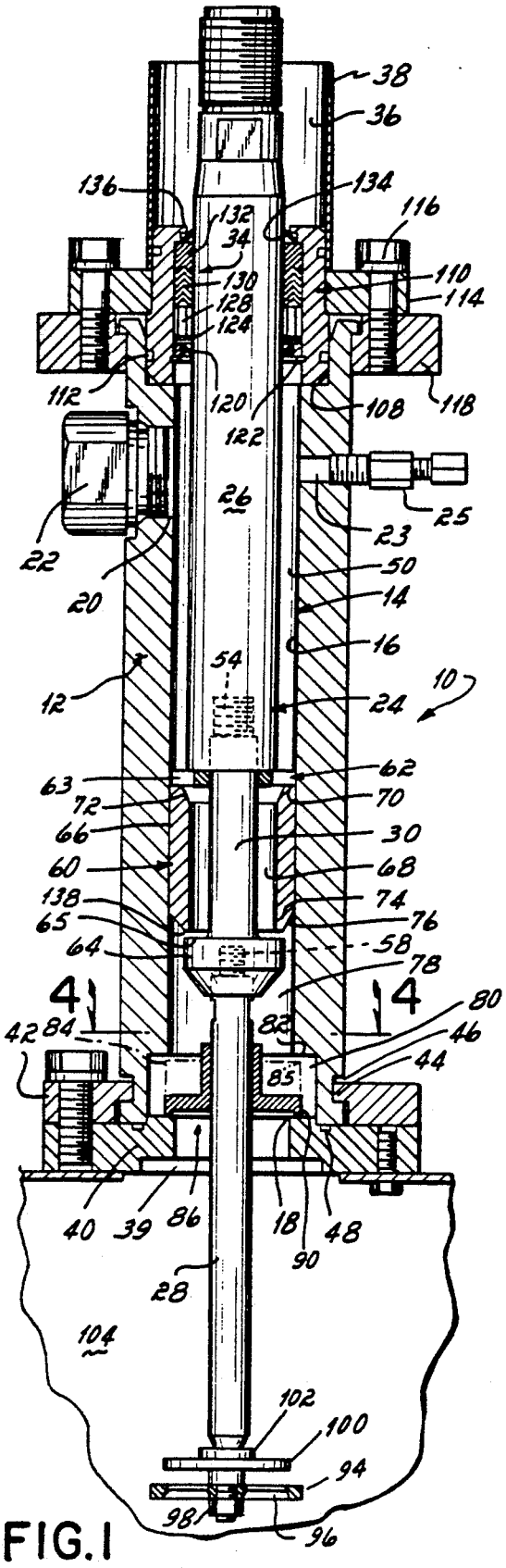
FIG. 1 is a cross sectional view of the pump of this invention shown during a downstroke movement of its piston assembly.

Referring now to the Figs., the dual-acting, reciprocating piston pump 10 of this invention includes a pump body 12 formed with a stepped passageway 14 defining an internal wall 16. The lower end of the passageway 14 is formed with a material inlet 18, and a discharge outlet 20 is formed in the pump body 12 at the upper portion of passageway 14 which carries an adaptor 22. A bleed and prime port 23 is also connected to the passageway 14 which mounts a bleeder valve 25. As used herein, the term "upper" refers to the top portion of the pump body 12 as viewed in the Figs., and the terms "lower" or "down" refer to the bottom portion of the pump body 12.

As discussed in more detail below, the passageway 14 of the pump body 12 receives a piston assembly 24 consisting of a plunger rod 26, a shovel rod 28 and a rod connector 30 which interconnects the plunger rod 26 and shovel rod 28 The piston assembly 24 is reciprocated with respect to the pump body 12 by an air motor (not shown), or any other suitable type of reciprocating mechanism. The upper end of the plunger rod 26 of piston assembly 24 is carried by a packing cartridge 34, described below, and is movable within a solvent chamber 36 formed by a cylindrical housing or cap 38 mounted atop the pump body 12. The shovel rod 28 at the bottom portion of piston assembly 24 extends through the outlet 18 of passageway 14 and through a stepped bore 39 formed in a valve seat plate 40 which is retained on the base of pump body 12 by a clamp 42 and screws 43. The clamp 42 is formed with an annular flange 44 received within a recess 46 formed at the base of pump body 12. An O-ring 48 is preferably interposed between the valve seat plate 40 and the lowermost edge of the pump body 12. The aforementioned elements which connect to the top and bottom of pump body 12 are easy to disassemble for maintenance of the pump 10, as desired.

Figure 2:
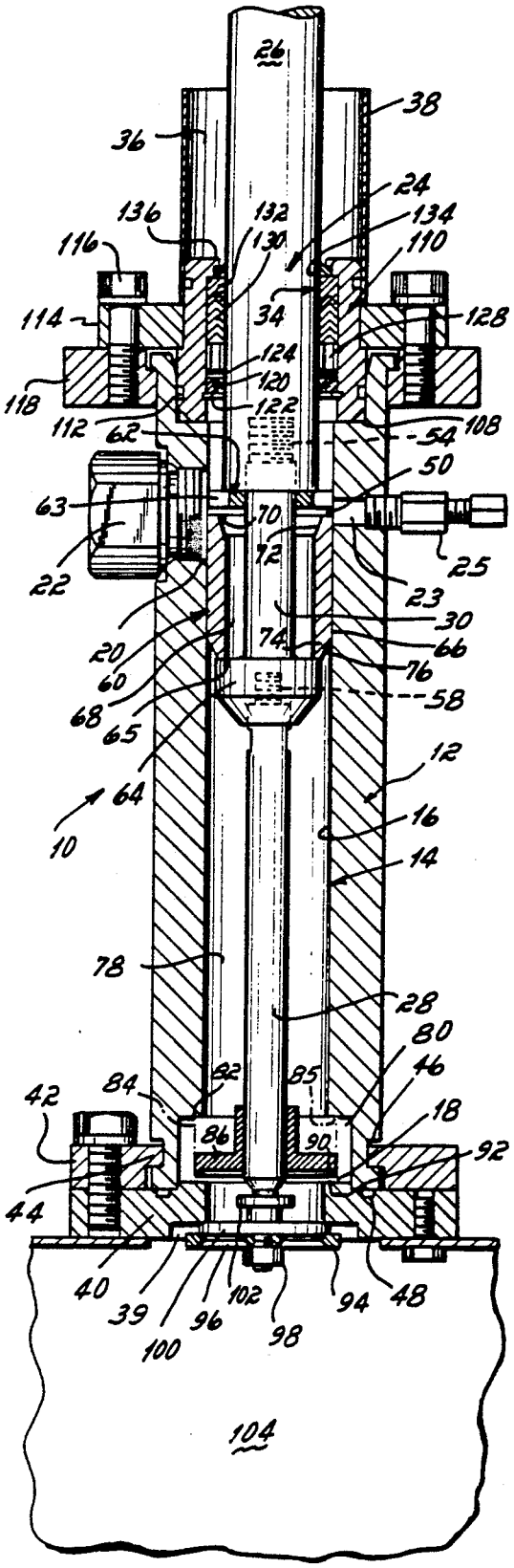
FIG. 2 is a view similar to FIG. 1 except during an upstroke movement of the piston assembly.

Referring to FIGS. 1 and 2, the construction of the piston assembly 24 is illustrated in detail. The plunger rod 26 portion of piston assembly 24 is cylindrical in shape and has a diameter which is at least about 0.50 inches less than the diameter of the passageway 14. The space between the plunger rod 26 and wall 16 forms an upper pumping chamber 50 which varies in longitudinal dimension during the upstroke and downstroke movements of the piston assembly 24, as described below, but maintains communication with the discharge outlet 20 in pump body 12. The lower end of plunger rod 26 is formed with an internally threaded bore which receives the threaded end 54 of the rod connector 30. Similarly, the lower end of rod connector 30 is formed with an internally threaded bore which mounts the threaded end 58 of the shovel rod 28. The plunger rod 26, shovel rod 28 and rod connector 30 are therefore connected as an essentially unitary piston assembly 24, but each of these elements are easily assembled and disassembled from one another to permit repair or replacement of same.

In the presently preferred embodiment, a tubular-shaped upper check valve 60 is carried by the rod connector 30 between a spider or valve plate 62 mounted on the lowermost end of plunger rod 26, and a valve seat 64 formed on the lower portion of rod connector 30. The valve plate 62 is a flat disc formed with a number of apertures 63 which communicate with the upper pumping chamber 50. The valve seat 64 formed on rod connector 30 has an annular upper surface 65 formed to engage the upper check valve 60 as described below.

As viewed in the Figs., the upper check valve 60 has a tubular wall defining an outer surface 66 and an inner surface forming a throughbore 68 which receives the rod connector 30. The upper end 70 of upper check valve 60 is formed with a radially outwardly extending chamfer 72, and the lower end 74 thereof is formed with a radially inwardly extending chamfer 76. As discussed below in connection with a description of the operation of pump 10, the upper check valve 60 is movable between an open position as shown in FIG. 1 in which its upper end 70 contacts the valve plate 62 and its lower end 74 disengages the valve seat 64, and a closed position shown in FIG. 2 wherein the lower end 74 of upper check valve 60 engages the valve seat 64 of rod connector 30 and its upper end 72 disengages the valve plate 62.

Figure 4:
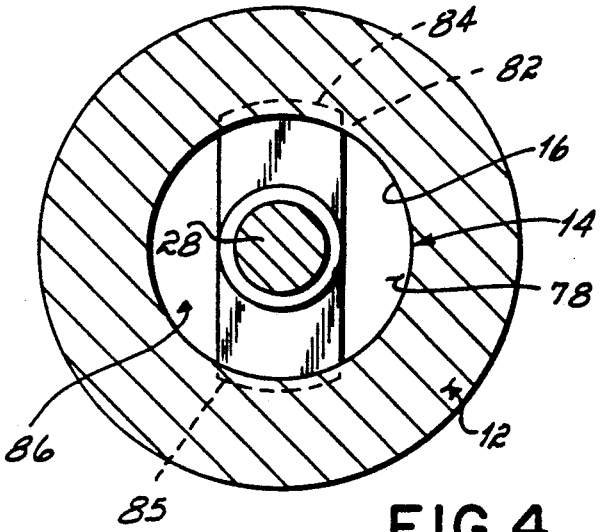
FIG. 4 is a plan view of the lower check valve herein taken generally along line 4—4 of FIG. 1.

With reference to the lower portion of FIGS. 1 and 2, a lower pumping chamber 78 is formed in the bottom portion of passageway 14 beneath the upper check valve 60. The longitudinal dimension of this lower pumping chamber 78 varies during the movement of piston assembly 24, and its volume is considerably greater than that of upper pumping chamber 50 because the shovel rod 28 carried within the lower pumping chamber 78 is about 0.75 inches in diameter whereas the plunger rod 26 carried in the upper pumping chamber 50 is about 1.625 inches in diameter. The bottom portion of lower pumping chamber 78 has an outwardly stepped area 80 forming an annular shoulder 82 which engages opposed flanges 84, 85 of a lower check valve 86. As viewed in FIGS. 1, 2 and 4, the lower check valve 86 has a throughbore which receives the shovel rod 28, and an annular ring 90 is formed at the bottom surface of lower check valve 86 which engages the top surface of valve seat plate 40 over the stepped bore 39. As discussed below in connection with the operation of pump 10, the lower check valve 86 is movable between a closed position as viewed in FIG. 1 wherein its annular ring 90 engages the valve seat plate 40, and an open position is viewed in FIG. 2 in which the upper surface of flanges 84, 85 engage the shoulder 82, thus forming a passage 92 for the movement of material through the stepped bore 39 in seat plate 40, through the inlet 18 of passageway 14 and past the lower check valve 86 into the lower pumping chamber 78.

In the presently preferred embodiment, the shovel rod 28 extends through the lower check valve 86, the inlet 18 of passageway 14 and the stepped bore 39 in seat plate 40. The lowermost end of shovel rod 28 mounts a shovel disc 94 formed with apertures 96. A self-locking nut 98 is threaded onto the lowermost end of shovel rod 28 to retain the shovel disc 94 in a fixed position thereon. A washer plate 100 is carried on the shovel rod 28 above the shovel disc 94 and is movable therealong between the shovel disc 94 and a washer retainer 102 fixedly mounted to the shovel rod 28. As discussed below, the shovel rod 28, shovel disc 94 and washer plate 100 are adapted to be inserted within a source of material to be pumped such as a container 104, and are effective to scoop material from such container 104 into the lower pumping chamber 78 of pump body 12.

Figure 3:
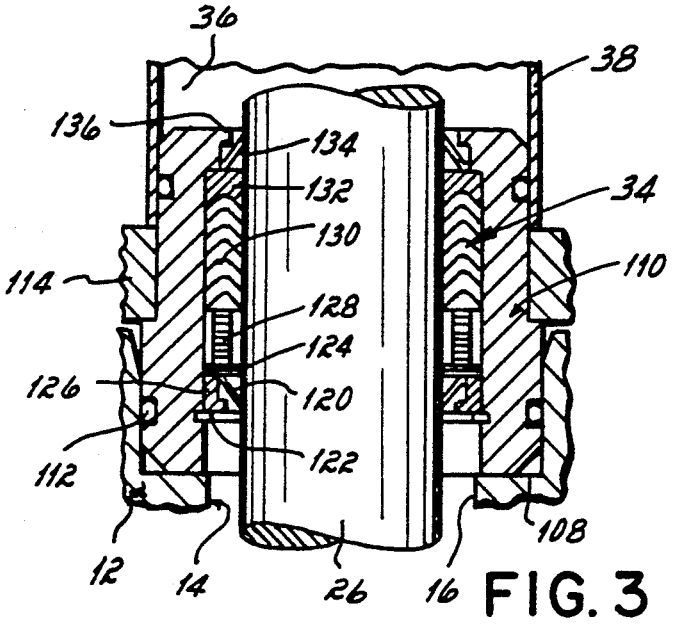
FIG. 3 is an enlarged view of the packing cartridge at the upper end of the pump body.

Before describing the operation of pump 10, reference is made to FIG. 3 and the top of FIGS. 1 and 2 where the packing cartridge 34 which carries the upper portion of plunger rod 26 is illustrated in detail. The construction of packing cartridge 34 forms no part of this invention per se and is thus described only briefly herein.

The upper portion of the passageway 14 in pump body 12 is formed with a radially outwardly stepped area defining an annular seat 108. This annular seat 108 mounts a V-ring gland 110 which is sealed by an O-ring 112 against the wall of pump body 12 and is retained within the annular seat 108 by a gland retainer ring 114. This gland retainer ring 114 is connected by bolts 116 to a mounting plate 118 which interconnects the pump body 12 to the air motor in a manner not shown.

The other elements of packing cartridge 34 are located radially inwardly from the V-ring gland 110 adjacent the plunger rod 26. One of these elements is a lower rod wiper 120 which engages the exterior surface of the plunger rod 26. The lower rod wiper 120 is mounted in position between a retaining ring 122, a spacer 124 and a scraper retainer 126. The spacer 124 is urged against the scraper retainer 126 by a compression spring 128 whose opposite end bears against a Teflon V-ring 130. The opposite end of this Teflon V-ring 130 is received in a V-ring adaptor 132 which holds a second, upper rod wiper 134 within a seat 136 formed at the top of the V-ring gland 110. These aforementioned elements of packing cartridge 34 effectively seal the upper pumping chamber 50 from the solvent chamber 36 as the plunger rod 26 is reciprocated within the pump passageway 14, and are easily removable to permit access to the interior of pump body 12 for maintenance. The wipers 120, 134 help scrape or wipe material from the outside surface of the plunger rod 26, and the plunger rod 26 is further cleaned by solvent within the solvent chamber 36 as it moves therethrough.

Pump Operation

Referring now to FIGS. 1 and 2, the operation of pump 10 is illustrated in a sequence wherein a downstroke of the piston assembly 24 is shown in FIG. 1 and an upstroke of piston assembly 24 appears in FIG. 2. It is assumed for purposes of the present discussion that material is present within both the upper pumping chamber 50 and lower pumping chamber 78 either as the result of an initial delivery of the material therein through port 23 or due to previous operation of the pump 10.

In the course of a downstroke or downward movement of the piston assembly 24, the upper check valve 60 is moved to an open position and the lower check valve 86 is simultaneously moved to a closed position to permit the discharge of material from the upper pumping chamber 50 through discharge outlet 20. As the piston assembly 24 moves downwardly, the material located within the lower pumping chamber 78 forces the upper check valve 60 in an upward direction such that the upper end 70 of upper check valve 60 engages the valve plate 62 carried by the base of plunger rod 26, and the lower end 74 of upper check valve 60 disengages the valve seat 64 of rod connector 30. A flow path or gap 138 is thus created between the lower end 74 of upper check valve 60 and the valve seat 64 which permits the passage of material from the lower pumping chamber 78, into the throughbore 68 of upper check valve 60, and then through the apertures 63 in valve plate 62 to the upper pumping chamber 50 for emission from discharge outlet 20.

As mentioned above, in order for material to be transferred from the lower pumping chamber 78 into the upper pumping chamber 50, the lower check valve 86 must be moved to a closed position at the same time upper check valve 60 is opened. As the piston assembly 24 moves downwardly, the rod connector 30, upper check valve 60 and plunger rod 26 initially force material contained within lower pumping chamber 78 downwardly, thus moving the annular ring 90 of lower check valve 86 into a closed, seated position against the seat plate 40. With the lower check valve 78 closed, the material cannot escape from the lower pumping chamber 78 through the bore 39 in seat plate 40, and therefore such material must move in an upward direction along the aforementioned flow path into the upper pumping chamber 50 for discharge through the discharge outlet 20. As seen in the Figs., and discussed above, the volume of the lower pumping chamber 78 is substantially greater than that of the upper pumping chamber 50 so that displacement of the material from lower pumping chamber 78 not only fills the upper chamber 50, but results in the expulsion of material from the upper pumping chamber 50 through its discharge outlet 20.

At the same time material is being forced from the lower pumping chamber 78 into the upper pumping chamber 50, in response to downward movement of the piston assembly 24, the shovel rod 28, shovel disc 94 and washer plate 100 are moved into the interior of container 104 filled with the material to be pumped. In the course of downward movement of the shovel rod 28, the slidable washer plate 100 is forced out of engagement with the shovel disc 94 against the washer retainer 102. Because the shovel disc 94 has apertures 96, downward movement of the shovel disc 94 and shovel rod 28 within the container 104 is made easier because the material can flow through such apertures 96 as well as around the shovel disc 94.

Pumping of material from the upper pumping chamber 50 through discharge outlet 20 is also obtained during the reverse, upstroke movement of piston assembly 24. With reference to FIG. 2, as the piston assembly 24 begins to move upwardly, material within the upper pumping chamber 50 immediately forces the upper check valve 60 into sealing engagement with the valve seat 64 of rod connector 30. The chamfered, lower end 74 of upper check valve 60 is effective to cleanly and quickly cut off the flow of material from the lower pumping chamber 78 into the upper pumping chamber 50 through the gap 138 described above. At the same time the upper check valve 60 is moved to the closed position, the lower check valve 86 is moved to an open position wherein its flanges 84, 85 contact the shoulder 82 in pump body 12 and the annular ring 90 disengages seat plate 40. This movement of lower check valve 86 is created because the shovel disc 94 and washer plate 100 scoop material from the inside of container 104 and begin to force it through the stepped bore 39 in seat plate 40, and then through the inlet 18 of passageway 14 into the lower pumping chamber 78. Movement of the piston assembly 24 in an upward direction continues until such time as the washer plate 100 seats within the stepped bore 41 of seat plate 40.

As viewed in FIG. 2, the upward stroke of piston assembly 24 forces material within the upper pumping chamber 50 through its discharge outlet 20 as the plunger rod 26, upper check valve 60 and rod connector 30 all move upwardly within the upper pumping chamber 50. As material is forced from upper pumping chamber 50, the lower pumping chamber 78 is being filled with material scooped from the container 104 by shovel disc 94. As shown in FIG. 2, the lower pumping chamber 78 has a relatively large volume with the piston assembly 24 at the top of its upstroke position, and it is this relatively large quantity of material which is directed into the upper pumping chamber 50 during the downstroke movement of piston assembly 24 as described above.

In the course of both the downstroke and upstroke motions of piston assembly 24, the outer surface 66 of upper check valve 60 slidingly contacts the inner wall 16 of passageway 14 to scrape or wipe material therefrom and deposit such material either in the upper or lower pumping chambers 50, 78. This metal-to-metal contact between the inner wall 16 and upper check valve 60 helps reduce "packing out" or build-up of material along the wall 16. Additionally, the above-described flow path between the lower pumping chamber 78 and the upper pumping chamber 50, through the upper check valve 60 and valve plate 62, is both relatively short and large in dimension so as to reduce excessive shearing of material passing therethrough and also to reduce pressure loss between the lower pumping chamber 78 and upper pumping chamber 50.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A double-acting, reciprocating piston pump, comprising:

a pump body formed with a passageway defining an internal wall, said passageway having an inlet adapted to communicate with a source of material to be pumped, and a discharge outlet at which material exits said pump body;

a piston assembly movable in first and second directions relative to said pump body, said piston assembly including a first portion located within said passageway in said pump body and a second portion adapted to be inserted within a source of material to be pumped, said first portion carrying a valve seat, said second portion carrying shovel means for scooping material from the source and through said inlet in said passageway of said pump body;

a first check valve carried by said first portion of said piston assembly, said first check valve dividing said passageway into a first pumping chamber connected to said inlet of said passageway and a second pumping chamber connected to said discharge outlet of said passageway, said first check valve being formed with a throughbore and an outer surface slidably engageable with said internal wall of said pump body formed by said passageway, said first check valve being mounted within said passageway by said piston assembly so that said outer surface of said first check valve scrapes away material from said internal wall of said pump body along at least a portion of said first pumping chamber and along said second pumping chamber to said discharge outlet of said passageway, said first check valve and said valve seat being mounted for relative movement between an open position in which said first check valve is spaced from said valve seat and a closed position in which said first check valve contacts said valve seat;

a second check valve located within said passageway and movable between an open position and a closed position relative to said inlet to said passageway, whereby said first check valve is moved to said open position and said second check valve is moved to said closed position in response to movement of said piston assembly in said first direction to force material located in said first pumping chamber into said space between said first check valve and said valve seat, through said throughbore in said first check valve and into said second pumping chamber for emission through said discharge outlet, said first check valve being moved to said closed position and said second check valve being moved to said open position in response to movement of said piston assembly in said second direction to force material located within said second pumping chamber through said discharge outlet and to simultaneously scoop material with said shovel means through said inlet and into said first pumping chamber.

2. The pump of claim 1 in which said piston assembly comprises:

a plunger rod located within said passageway;

a shovel rod extending through said inlet in said passageway and being adapted to be inserted within the source of material to be pumped;

a rod connector interconnecting said plunger rod and said shovel rod, said rod connector being formed with said valve seat.

3. The pump of claim 2 in which said plunger rod mounts a valve plate spaced from said valve seat so that said first check valve is located on said connector rod between said valve plate and said valve seat, said valve plate being formed with apertures communicating with said throughbore in said first check valve.

4. The pump of claim 1 in which said first check valve comprises a tube having a cylindrical wall formed with said outer surface and first and second ends, one of said first and second ends of said tube being formed with a radially inwardly extending chamfer which engages said valve seat to cleanly cut off the flow of material from said first pumping chamber into said second pumping chamber upon movement of said piston assembly in said second direction.

5. A double-acting, recirpocating piston pump, comprising:

a pump body formed with a passageway defining an internal wall, said passageway having an inlet adpated to communicate with a source of material to be pumped, and a discharge outlet at which material exits the pump body;

a piston assembly movable in first and second directions relative to said pump body, said piston assembly comprising:

(i) a plunger rod located within said passageway in said pump body, said plunger rod mounting a valve plate formed with apertures;

(ii) a shovel rod adapted to be inserted within a source of material to be pumped, and (iii) a rod connector interconnecting said plunger rod and said shovel rod, said rod connector begin formed with a valve seat;

shovel means carried by said shovel rod of said piston assembly for scooping material from the source through said inlet in said passageway of said pump body;

a first check valve carried by said rod connector of said piston assembly between said valve plate and said valve seat, said first check valve dividing said passageway in said pump body into a first pumping chamber connected to said inlet of said passageway and a second pumping chamber connected to said discharge outlet of said passageway, said first check valve having a tubular wall forming a central throughbore and an outer surface which slidably engages said internal wall of said pump body, said first check valve being mounted within said passageway by said rod connector so that said outer surface of said tubular wall scrapes away material from said internal wall of said pump body along at least a portion of said first pumping chamber an along said second pumping chamber to said discharge outlet of said passageway, said first check valve and said valve seat being mounted for relative movement between an open position in which said first check valve is spaced from said valve seat and a closed position in which said check valve contacts said valve seat;

a second check valve carried by said shovel rod within said first pumping chamber and movable between an open position and a closed position relative to said inlet to said passageway, whereby said first check valve is moved to said open position and said second check valve is moved to said closed position in response to movement of said piston assembly in said first direction to force material located in said first pumping chamber into said space between said first check valve and said valve seat, through said throughbore in said first check valve and into said second pumping chamber for emission through said discharge outlet, and whereby said first check valve is moved to said closed position and said second check valve is moved to said open position in response to movement of said piston assembly in said second direction to force material located within said second pumping chamber through said discharge outlet and to simultaneously scoop material with said shovel means through said inlet and into said first pumping chamber.

* * * * *